US006839443B2

(12) United States Patent
Fukuda

(10) Patent No.: US 6,839,443 B2
(45) Date of Patent: Jan. 4, 2005

(54) BONE CONDUCTION SPEAKER

(75) Inventor: Mikio Fukuda, Tokyo (JP)

(73) Assignee: Temco Japan Co., Ltd., Tokyo (JP)

( * ) Notice: Subject to any disclaimer, the term of this patent is extended or adjusted under 35 U.S.C. 154(b) by 0 days.

(21) Appl. No.: 10/220,036

(22) PCT Filed: Dec. 7, 2001

(86) PCT No.: PCT/JP01/10735

§ 371 (c)(1),
(2), (4) Date: Aug. 27, 2002

(87) PCT Pub. No.: WO02/054824

PCT Pub. Date: Jul. 11, 2002

(65) Prior Publication Data

US 2003/0012395 A1 Jan. 16, 2003

(30) Foreign Application Priority Data

Dec. 27, 2000 (JP) ..... 2000-396495

(51) Int. Cl.[7] ..... H04R 25/00
(52) U.S. Cl. ..... 381/151; 381/326; 381/380
(58) Field of Search ..... 381/151, 326, 381/380, 396, 412, 417

(56) References Cited

U.S. PATENT DOCUMENTS 2,459,325 A * 1/1949 Hugh ..... 381/151
4,843,628 A * 6/1989 Hofer ..... 381/345
2003/0048913 A1 * 3/2003 Lee et al. ..... 381/151

FOREIGN PATENT DOCUMENTS

JP 29-14924 11/1954
JP 60-84096 5/1985

* cited by examiner

*Primary Examiner*—Curtis Kuntz
*Assistant Examiner*—Brian Ensey
(74) *Attorney, Agent, or Firm*—Browdy and Neimark, P.L.L.C.

(57) ABSTRACT

A bone conduction speaker, in which a sound is sufficiently improved in tone quality by suppressing an unnecessary vibration of a vibration system and preventing generation of an abnormal sound due to an abnormal resonance, comprise: a bone conduction speaker unit constructed of a yoke, a voice coil, a magnet, a vibrating plate and a vibration block integrated with the vibrating plate; and, a housing which contains the bone conduction speaker unit to function as a vibrating portion; wherein; the vibration block of the bone conduction speaker unit is fixedly mounted on an upper surface of the interior of the housing; and, the yoke is supported by the damping member which is disposed inside the housing.

2 Claims, 4 Drawing Sheets

BONE CONDUCTION SPEAKER

FIELD OF THE INVENTION

The present invention relates to a bone conduction speaker, and more particularly to a bone conduction speaker of a type adapted to be held in abutting contact with a head portion of a user for transmitting a vibration of a vibrating plate of the bone conduction speaker to a bone tissues of the head portion of the user, which makes it possible for the user to latch the sound.

BACKGROUND OF THE INVENTION

In general, a conventional bone conduction speaker has a construction shown in each of FIGS. 6 and 7. The conventional bone conduction speaker shown in FIG. 6 is constructed of a yoke 23, which is provided with a voice coil 21 and a magnet 22, wherein: through a diaphragm or vibrating plate 25 fixedly mounted on an upper surface of the yoke 23 and a vibrating block 27, the yoke 23 is mounted on a ceiling surface of the interior of a housing 24 in a suspending manner.

The above construction of the conventional bone conduction speaker is advantageous in that it is easily assembled and capable of obtaining a relatively large output. On the other hand, the conventional bone conduction speaker is disadvantageous in that: since the yoke 23 is suspended from the vibrating plate 25, a value of "Q" (a sharpness of resonance, which is directly proportional to an equivalent mass of the vibrating system) of a resonance portion which is determined by a mass of a vibrating system and the like increases to have a curve of the frequency characteristics of the bone conduction speaker be out of a flat shape. As a result, a reproduced sound having a minimum resonance frequency becomes loud to impair the sound in tone quality, which the user often feels as an unfavorable vibration. Further, due to the above construction, when the sound varies in frequency, an abnormal resonance of the vibrating plate tends to occur, which leads to an abnormal sound reproduced at a frequency of the resonance. This is a problem inherent in the conventional bone conduction speaker.

On the other hand, the other one (shown in FIG. 7) of the conventional bone conduction speakers has a construction in which: the yoke 23 provided with the voice coil 21 and the magnet 22 is fixedly mounted on a bottom surface of the interior of the housing 24 which is provided with an opening 28 in its upper surface; the vibrating plate 25 is fixedly mounted on an upper surface of the yoke 23; and, a vibrating portion 26 is vibrated in operation, fixedly mounted on the vibrating plate 25 through the vibration block 27, and exposed to the outside through the opening 28 of the housing 24, wherein the vibrating portion 26 is held in abutting contact with a head portion of a user in use.

Also in this case, as is in the above-described bone conduction speaker, since the vibrating system is suspended, there is the same problem as that described in the above more or less.

Further, in the case of this construction, since an air gap or opening 28 is disposed adjacent to an outer peripheral portion of the vibrating portion 26, there is a fear that some foreign material such as dust, the user's sweat and like foreign materials enters the housing 24, which often causes a failure of the conventional bone conduction speaker.

Since the conventional bone conduction speaker suffers from the above-mentioned problems, it is an object of the present invention to provide a bone conduction speaker free from the above problems. In other words, it is an object of the present invention to provide a bone conduction speaker having a construction in which: an unnecessary vibration of a vibrating system is suppressed so that any abnormal sound resulted from an abnormal resonance is prevented from being issued, whereby the sound issued from the bone conduction speaker is sufficiently improved in tone quality.

It is another object of the present invention to provide a bone conduction speaker, which is sufficiently tough so as to not break even when it is excessively vibrated and dropped from the user's head and therefore subjected to a mechanical shock.

SUMMARY OF THE INVENTION

The above objects of the present invention are achieved by providing: a bone conduction speaker comprising: a bone conduction speaker unit constructed of a yoke, a voice coil, a magnet, a vibrating plate and a vibration block integrated with the vibrating plate; and, a housing which contains the bone conduction speaker unit to function as a vibrating portion, wherein: the vibration block of the bone conduction speaker unit is fixedly mounted on an upper surface of the interior of the housing; and, the yoke is supported by the damping member which is disposed inside the housing.

In one of preferable embodiments of the present invention: the damping plate is constructed of a leaf spring which is fixedly mounted on an side surface of the interior of the housing; and, the yoke is fixedly mounted on the leaf spring through a leaf-spring mounting portion of the yoke, wherein the leaf-spring mounting portion is provided in a central portion of a rear surface of the yoke. In the other of the preferred embodiments of the present invention: the damping member is constructed of an elastic block made of rubber, plastics or like elastic materials, wherein the elastic block is mounted on a bottom surface of the interior of the housing; and, the yoke has its rear surface fixedly mounted on an upper surface of said elastic block.

BEST MODE FOR CARRYING OUT THE INVENTION

Figure 1:
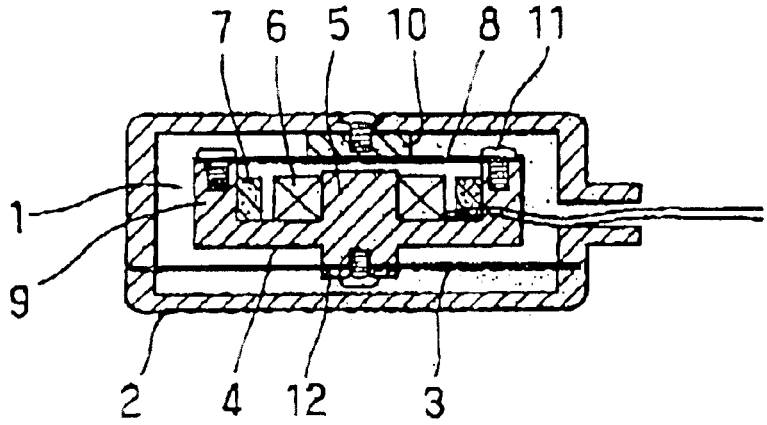
FIG. 1 is a longitudinal sectional view of an embodiment of the bone conduction speaker of the present invention.
Figure 2:
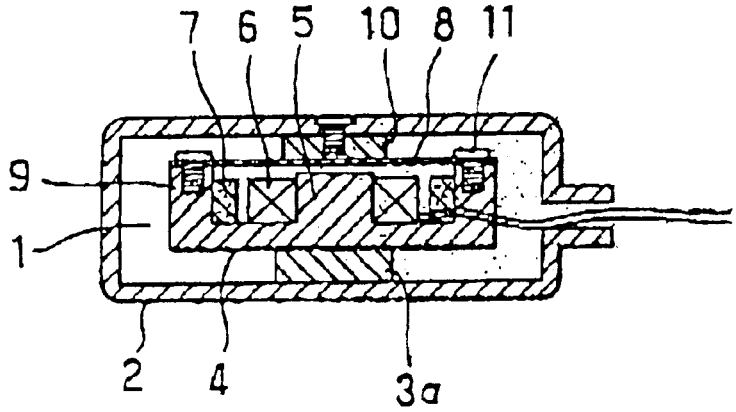
FIG. 2 is a longitudinal sectional view of an other embodiment of the bone conduction speaker of the present invention.

With reference to the accompanying drawing, a plurality of embodiments of the present invention will be described. Each of FIGS. 1 and 2 shows a longitudinal sectional view of each of embodiments of a bone conduction speaker of the present invention. The bone conduction speaker of the present invention comprises: a bone conduction speaker unit 1; a housing 2 for containing the speaker unit 1; and, a damping member for supporting the bone conduction speaker unit 1, wherein the damping member is disposed in the housing 2.

In general, the bone conduction speaker unit 1 is constructed of: a yoke 4 provided with a central magnetic pole 5; a doughnut-shaped voice coil 6 which is wound around the central magnetic pole 5; a magnet 7 disposed outside the voice coil 6; a diaphragm or vibrating plate 8 mounted on an upper surface of a diaphragm-mounting portion 9, which portion 9 is formed in an upper surface of an outer peripheral portion of the yoke 4; and, a vibration block 10 fixedly mounted on the upper surface of the vibrating plate B.

In the bone conduction speaker unit 1, the vibration block 10 is fixedly mounted on a ceiling surface of the interior of the housing 2 through a plurality of screws; 11 and like fastening means. In the present invention, the bone conduction speaker unit 1 is further supported by the damping member, which is disposed inside the housing 2.

The damping member shown in FIG. 1 is constructed of a leaf spring 3. This leaf spring 3 has its outer peripheral portion fixedly embedded in an inner surface of the housing 2, and has its central portion fixedly mounted a lower surface of a central portion 12 of the yoke 4, wherein the central portion 12 serves as a leaf-spring mounting portion.

This leaf spring 3 functions to damp the vibrations of the bone conduction speaker unit 1, and pre vents the same unit 1 from being excessively vibrated. As for a damping force exerted by the leaf spring 3, it is possible to control such a damping force by appropriately selecting the material thickness and like properties of the leaf spring 3.

The damping member shown in FIG. 2 is constructed of an elastic block 3*a*, which is made of rubbers, plastics and like elastic materials. This elastic block 3*a* is any one of rubber blocks, plastic blocks and like elastic blocks; and fixedly mounted on an inner bottom surface of the housing 2. On the other hand, an upper surface of this elastic block 3*a* is fixedly mounted on a lower surface of the central portion of the yoke 4. As is in the case of the leaf spring 3, this elastic block 3*a* also functions to damp the vibrations of the bone conduction speaker unit 1.

It is needless to say that it is an object of the damping member to prevent the bone conduction speaker-unit 1 from being excessively vibrated. At the same time, it must be noted that the vibration of the bone conduction speaker unit 1 is not excessively damped.

Figure 3:
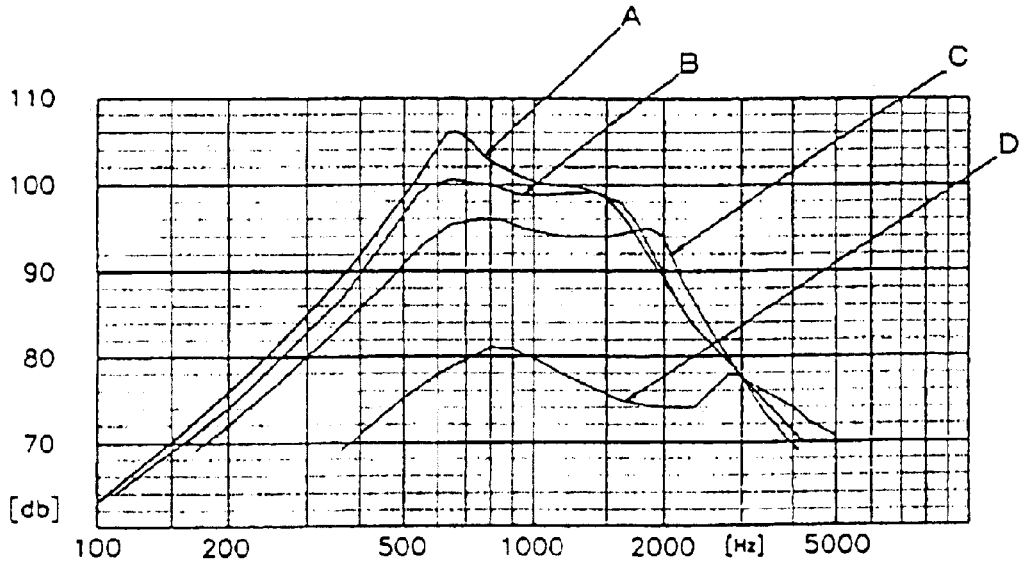
FIG. 3 is a diagram illustrating the relationship between an input frequency and the strength of an output.

FIG. 3 shows a diagram illustrating the relationship between an input frequency and the strength of an output in various conditions, for example, in the presence or absence the damping member, in a condition in which the damping member has its elasticity vary.

A curve "A" in FIG. 3 shows the relationship between an input frequency and an output of a conventional type of a bone conduction speaker, which is not provided with any damping member. In FIG. 3, at an input frequency of 650 (Hz); the curve "A" reaches its peak. As shown in this curve "A", when the curve "A" is out of a flat shape, the resonance curve "A" forms its peak. Around this peak of the curve "A", resonance of the sound is strengthened so that the sound is deteriorated in tone quality. Particularly, in the case of the bone conduction speaker, an increase in loudness of the sound means an increase in vibration of the sound. Due to this, a user of the bone conduction speaker often feels such an increase in loudness of the sound uncomfortable.

A curve "B" in FIG. 3 shows the relationship between an input frequency and an output of the bone conduction speaker of the present invention, wherein the bone conduction speaker is provided with a dumping member, which is large in elasticity. In this embodiment, the curve "B" is smaller in intensity of resonance than the curve "A". However, since the damping member of this embodiment is large in elasticity, it is impossible for this embodiment to prevent the resonance of the bone conduction speaker from occurring. This results in an excessive increase of the output of the bone conduction speaker of the embodiment, as a whole.

A curve "D" in FIG. 3 shows the relationship between an input frequency and an output of the bone conduction speaker of the present invention, wherein the bone conduction speaker is provided with a dumping member, which is small in elasticity. In this embodiment, Since the elasticity of the dumping member is too small, vibrations of the entire bone conduction speaker excessively decrease in amplitude.

A curve "C" in FIG. 3 shows the relationship between an input frequency and an output of the bone conduction speaker of the present invention, wherein each of dumping members 3, 3*a* of this embodiment is controlled in elasticity so as to have the curve "C" to approach an ideal curve. In this embodiment, it is recognized that the curve "C" is remarkably improved in building-up transient characteristics when a large input is inputted to this embodiment.

Figure 4:
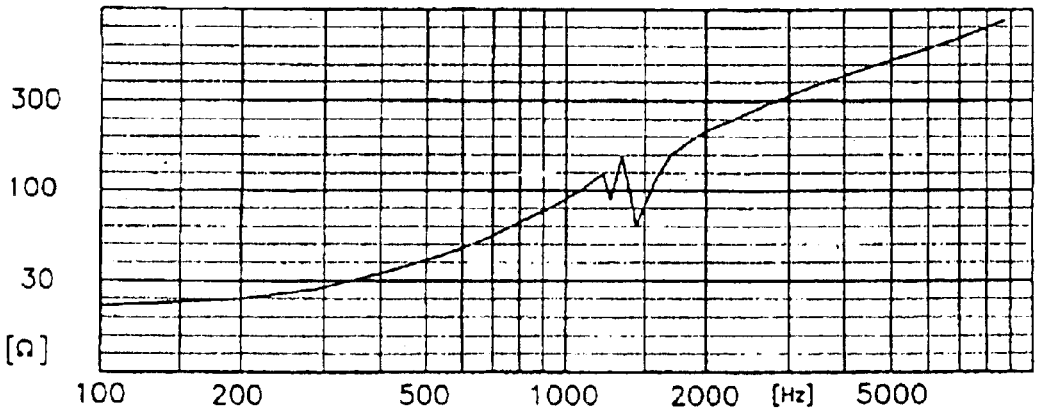
FIG. 4 Prior Art
FIG. 4 is a graph illustrating the impedance characteristics of the bone conduction speaker not provided with any damping member.

A curve in FIG. 4 shows the impedance characteristics of the conventional type of the bone conduction speaker in which any dumping member is not provided. In this conventional bone conduction speaker, since its vibrating plate or diaphragm suffers from an abnormal resonance, the frequency characteristics thereof thereof excessively vary in a range of from 1 KHz to 2 KHz so that an abnormal sound is issued.

Figure 5:
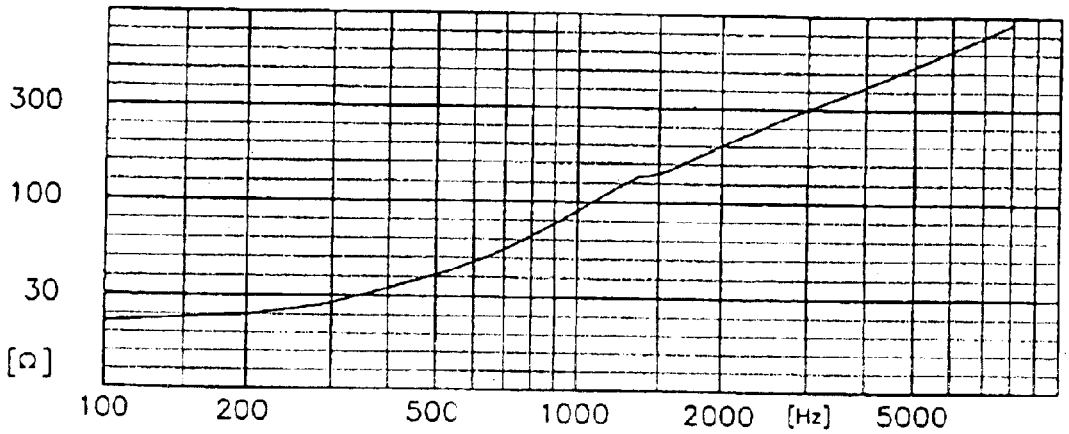
FIG. 5 is a graph illustrating the impedance characteristics of the bone conduction speaker provided with a damping member.
Figure 6:
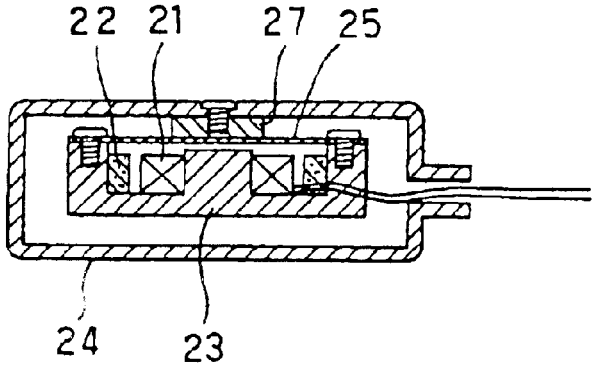
FIG. 6 Prior Art
FIG. 6 is a longitudinal sectional view of an example of a conventional type of a bone conduction speaker.
Figure 7:
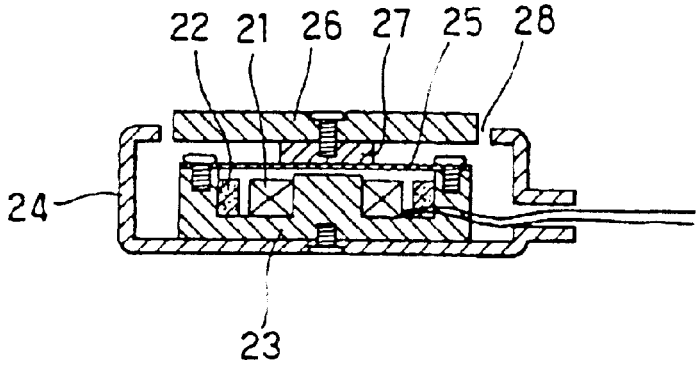
FIG. 7 Prior Art
FIG. 7 is a longitudinal sectional view of another example of the conventional type of the bone conduction speaker.

A curve in FIG. 5 shows the impedance characteristics of the bone conduction speaker provided with dumping member of the present invention. As is clear from this curve, in comparison with the conventional bone conduction speaker not provided with any damping member, the bone conduction speaker of the present invention is remarkably improved in frequency characteristics, which prevents such an abnormal sound of the conventional bone conduction speaker from being issued.

Incidentally, in construction each of components of the bone conduction speaker of the present invention may have any desired shapes and dimensions. For example, it is also possible to divide each of the diaphragm-mounting portion 9 of the yoke 4 and the magnet 7 into a plurality of diametrically-opposed pair of pieces which are disposed on the same diameter circle a center of which is coincident with a center of the central magnetic pole 5, so that the entire size of the bone conduction speaker unit 1 is minimized (as is in the prior art described in Japanese Patent No. 2967777).

INDUSTRIAL APPLICABILITY

The present invention has a construction described above. The bone conduction speaker unit is employed in the bone conduction speaker of the present invention, and supported by the damping member having an appropriate elasticity. This prevents the bone conduction speaker of the present invention from bring excessively vibrated. Due to this, it is possible for the bone conduction speaker of the present invention to improve the bone conduction speaker in frequency characteristics and therefore in toner quality, which enable the user to clearly catch the sound. Further, the damping member of the bone conduction speaker of the present invention is also capable of functioning as a shock absorber for absorbing any mechanical shock produced when the bone conduction speaker is vibrated or drops out of the user's head. Due to this, in effect, there is no fear that the bone conduction speaker of the present invention fails or breaks.

What is claimed is:

1. In a bone conduction speaker comprising: a bone conduction speaker unit constructed of a yoke, a voice coil, a magnet, a vibrating plate and a vibration block integrated with said vibrating plate; and a housing which contains said bone conduction speaker unit to function as a vibrating portion, wherein: said vibration block of said bone conduction speaker unit is fixedly mounted on an upper surface of the interior of said housing; said yoke is supported by a damping member which is disposed inside said housing; said damping plate is constructed of a leaf spring which is fixedly mounted on a side surface of the interior of said housing; said yoke is fixedly mounted on said leaf spring through a leaf-spring mounting portion of said yoke; and said leaf-spring mounting portion is provided in a central portion of a rear surface of said yoke, the improvement wherein said leaf spring has an outer peripheral portion fixedly embedded in an inner surface of said housing.

2. In a bone conduction speaker comprising: a bone conduction speaker unit constructed of a yoke, a voice coil, a magnet, a vibrating plate and a vibration block integrated with said vibrating plate; and, a housing which contains said bone conduction speaker unit to function as a vibrating portion, wherein: said vibration block of said bone conduction speaker unit is fixedly mounted on an upper surface of the interior of said housing; and said yoke is suspended from said vibrating plate and supported by a damping member which is disposed inside said housing, the improvement wherein: said damping member is constructed of an elastic block made of rubber, plastics or like elastic materials; said elastic block is mounted on a bottom surface of the interior of said housing; and said yoke has its rear surface fixedly mounted on an upper surface of said elastic block.

* * * * *